US007114574B2

(12) United States Patent
Bissonnette et al.

(10) Patent No.: US 7,114,574 B2
(45) Date of Patent: Oct. 3, 2006

(54) BY-PASS VALVE MECHANISM AND METHOD OF USE HEREOF

(75) Inventors: H. Steven Bissonnette, Sugar Land, TX (US); Keith A. Ryder, Richmond, TX (US); L. Michael McKee, Friendswood, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 290 days.

(21) Appl. No.: 10/772,616

(22) Filed: Feb. 5, 2004

(65) Prior Publication Data

US 2004/0159447 A1 Aug. 19, 2004

Related U.S. Application Data

(60) Provisional application No. 60/448,334, filed on Feb. 19, 2003.

(51) Int. Cl.
*E21B 23/06* (2006.01)
*E21B 33/12* (2006.01)

(52) U.S. Cl. ..... 166/386; 166/186; 166/387

(58) Field of Classification Search ..... 166/184, 166/186, 151
See application file for complete search history.

(56) References Cited

U.S. PATENT DOCUMENTS 2,878,877 A * 3/1959 Baker ..... 166/212
3,416,609 A * 12/1968 Kilgore ..... 166/131
3,434,538 A * 3/1969 Pumpelly et al. ..... 166/123
6,655,461 B1 * 12/2003 Eslinger et al. ..... 166/305.1

* cited by examiner

*Primary Examiner*—William Neuder
*Assistant Examiner*—Nicole Coy
(74) *Attorney, Agent, or Firm*—Rodney Warfford; Tim Curington; Robin Nava

(57) ABSTRACT

A by-pass valve mechanism for a well treatment tool having at least one flow sensitive element, permitting by-pass of well fluid past the flow sensitive element of the well treatment tool during conveyance of the well treatment tool to treatment depth within a well. A valve housing adapted for connection with a well tool defines an internal flow passage and has at least one by-pass port communicating well fluid between the flow passage of the service tool and the annulus between the well casing and the service tool. A sliding sleeve valve element is normally secured at its open position by shear elements permitting flow of well fluid through the and is moveable between an open position diverting fluid flow from within the service tool to the annulus and a closed position blocking the flow of well fluid through the by-pass port. The sleeve valve element is released and automatically closed by predetermined hydrostatic tubing or casing pressure or pump pressure. The by-pass valve mechanism may have a test pressure control system permitting pressure testing of a well without causing release and closure of the sleeve valve.

31 Claims, 4 Drawing Sheets

BY-PASS VALVE MECHANISM AND METHOD OF USE HEREOF

RELATED PATENT APPLICATION

Applicants hereby claim the benefit of U.S. Provisional Application Ser. No. 60/448,334 filed on Feb. 19, 2003 and entitled "By-pass Valve & Method", which provisional application is incorporated herein by reference for all purposes.

BACKGROUND OF THE INVENTION

1. Field of the Invention

The present invention relates generally to by-pass valves to provide for by-pass of fluid within a well casing past a well tool having packer elements as the tool is being run into a well to provide a well servicing activity. More particularly, the present invention concerns a by-pass valve having a unique closable sleeve valve that provides an alternative flow path for displaced well fluids to travel across flow sensitive or restrictive bottom hole assemblies.

2. Description of the Prior Art

The process of conveying tools into well bores filled with fluid generally involves a displacement of fluids. During conveyance of a well tool within a well, fluids must be transferred from below the tool into the tubing and/or annulus above the tool or vice versa. Bull-heading, i.e., displacing well fluid into a reservoir, is often unacceptable as it can lead to well control problems, cause formation damage and can induce pressure surges that are intolerable by some flow or pressure sensitive devices. In many applications the displaced fluid may be channeled around the tool and/or through the tool into the tubing. However, in some applications the tubing may be intentionally blocked, or the device may utilize cup type or flow sensitive sealing elements which may prevent displaced fluid flow externally of the tool.

Tools used in coiled tubing applications often restrict both the tubing and external flow paths, and may include cup type, pressure and flow sensitive sealing elements. These tools generally include a dedicated internal by-pass, or internal flow path. An internal by-pass through a tool is often defined as a tortuous or restricted flow path or paths which tend to restrict the flow of displaced fluid. To contend with such restrictions well service tools are often run in or moved at a slow controlled rate. Tools using cup type self energizing sealing elements are very sensitive to differential pressure or flow and may become prematurely energized if the tool run in speed exceeds the by-pass capabilities.

Mechanical by-pass valves, also referred to as unloader valves, which are normally actuated by axial motion, or a combination of axial and rotational motion, controlled from the surface have been used to allow self filling of the tubing and dedicated circulation paths, have been used in jointed pipe operations. Similar mechanical devices may have been used with coiled tubing, however, the inventors are not aware of the existence of any automatic, hydraulic type actuated valve used with coiled tubing for the purpose of relieving pressure sensitive devices or formations. Electronic/hydraulic, pressure operated valves such as the IRIS™ have also been used for similar jointed pipe applications; however, they are very complicated, expensive and, due to their relatively large OD (greater than 4") and long length, it is unlikely that such a valve could be feasibly applied to coiled tubing applications.

SUMMARY OF THE INVENTION

It is a primary feature of the present invention to provide a novel by-pass valve mechanism that is connected in assembly with a well tool having a flow passage, with the by-pass valve being open during run-in operations to provide a by-pass passage between the tool flow passage and the annulus between the tool and the casing for displaced well fluid and being closed responsive to the sensing of predetermined pressure to permit well service operations to be carried out.

It is another feature of the present invention to provide a novel by-pass valve mechanism that is closed responsive to hydrostatic pressure within a well, and when closed permits fluid treatment of the petroleum producing formation intersected by the well.

It is also a feature of the present invention to provide a novel by-pass valve mechanism that incorporates a test pressure control system and permits pressure testing of a well without causing pressure responsive closure of the sliding sleeve valve mechanism thereof.

It is an even further feature of the present invention to provide a novel by-pass valve mechanism that is closed responsive to hydrostatic pressure or pump pressure within a well and which achieves locking of the sliding sleeve valve element at its closed position to prevent inadvertent opening thereof responsive to treatment fluid injection pressure or formation pressure.

Briefly, a by-pass valve mechanism embodying the principles of the present invention comprises a unique closable sliding sleeve by-pass valve that is designed for connection with a well service tool to provide an alternate flow path for displaced well bore fluids to travel across flow sensitive or restrictive bottom hole assemblies. The additional flow path minimizes pressure surges and the thus minimizes the potential for prematurely energizing cup type seals while running the tool assembly into a well casing. The tool may also be used to minimize fluid loss and to minimize the potential for related well control problems.

The by-pass valve of the present invention allows a flow path from the tool or tubing internal diameter (ID) to the annulus between the well casing and service tool or vice-versa, and is generally placed just above a flow sensitive cup type sealing device. Once the well service tool is in its desired position within the well, or the need transferring of fluid across the tool is no longer present, the by-pass valve may be shifted to its closed position to isolate the tubing and annulus above the tool. The by-pass valve mechanism may be set to automatically close at a predetermined depth (responsive to predetermined hydrostatic pressure) or manually by pumping well treatment fluid or other fluid to achieve a predetermined set pressure for accomplishing closure of the by-pass valve.

The present invention employs a unique, ported sliding sleeve mechanism (by-pass valve) as an alternate flow path to improve the transfer of fluids across sensitive or restrictive tool assemblies. The alternate flow path is created by channeling fluid through the tool ID to the annulus between the well casing and the by-pass valve via by-pass ports that are defined by the valve body of the by-pass valve mechanism. The by-pass valve is designed with a substantially non-restricted flow path to reduce the effect of pressure surges and to allow faster run in rates of the well service tool. Decreasing pressure surges and flow along the tool exterior will also minimize wear of service tool and by-pass valve components and minimize the risk of the premature setting of flow and pressure sensitive sealing elements.

The by-pass valve mechanism is unique in that it is composed of a compact closable sliding sleeve which may set to close automatically at a predetermined depth, in response to hydrostatic pressure, or manually closed at a predetermined pump in pressure. Once closed the by-pass valve isolates the fluid supplying and tool conveyance tubing from the annulus between the well casing and the by-pass valve and provides a near smooth ID for high treatment fluid flow rate applications. Hydraulic areas are designed into internal by-pass valve components to maintain the valve mechanism tightly closed in response to applied tubing pressure.

The by pass valve is primarily intended to be used with cup type sealing devices such as CoilFRAC™ tools but may also be used with compression type sealing element devices. The by-pass valve may also be used with non-pressure sensitive tools to minimize formation damage from pressure surges and to minimize the fluid loss that is normally associated with the running in of tools on either coiled tubing or jointed pipe.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

IN THE DRAWINGS

Figure 1:
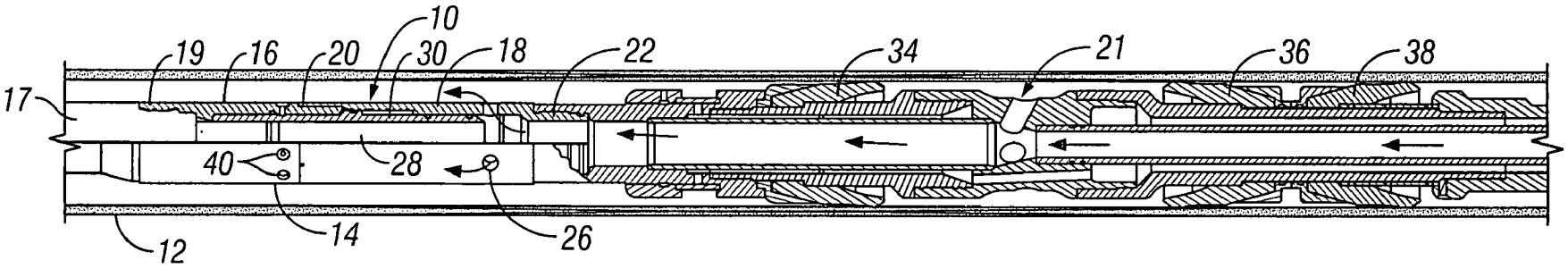
Figure 2:
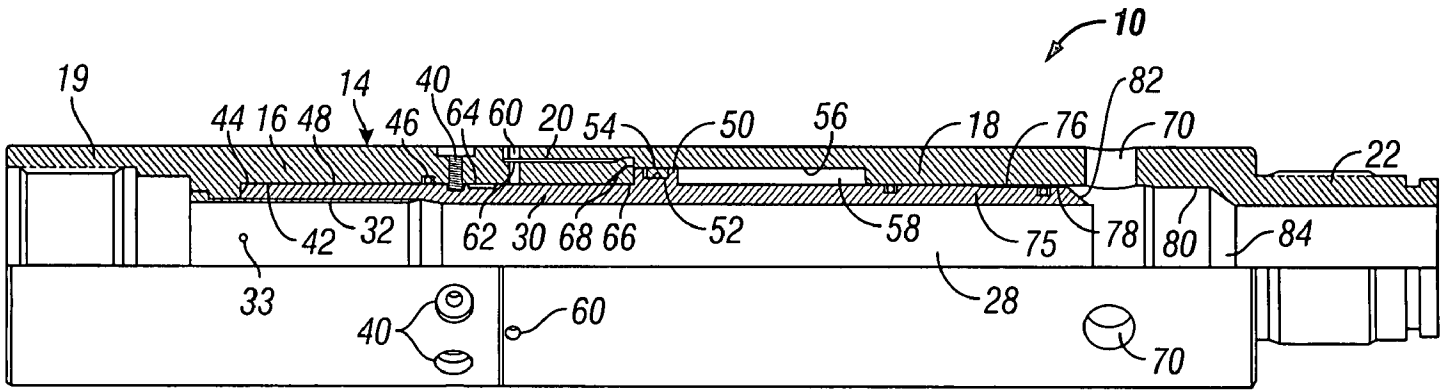
Figure 3A:
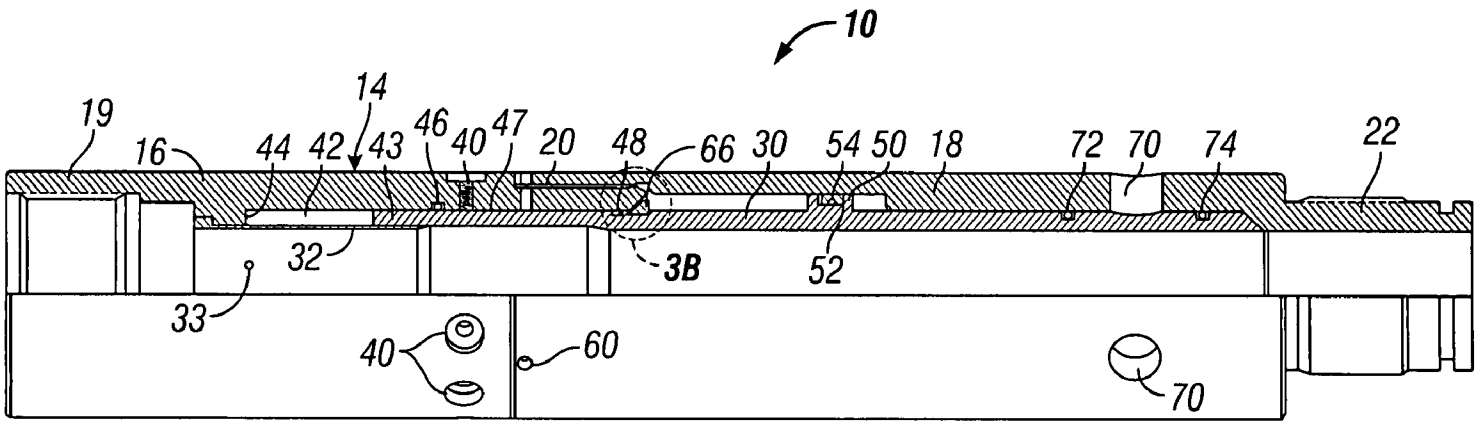
Figure 3B:
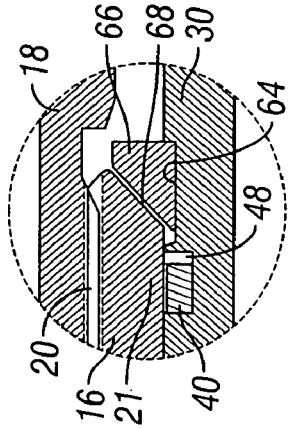
Figure 4:
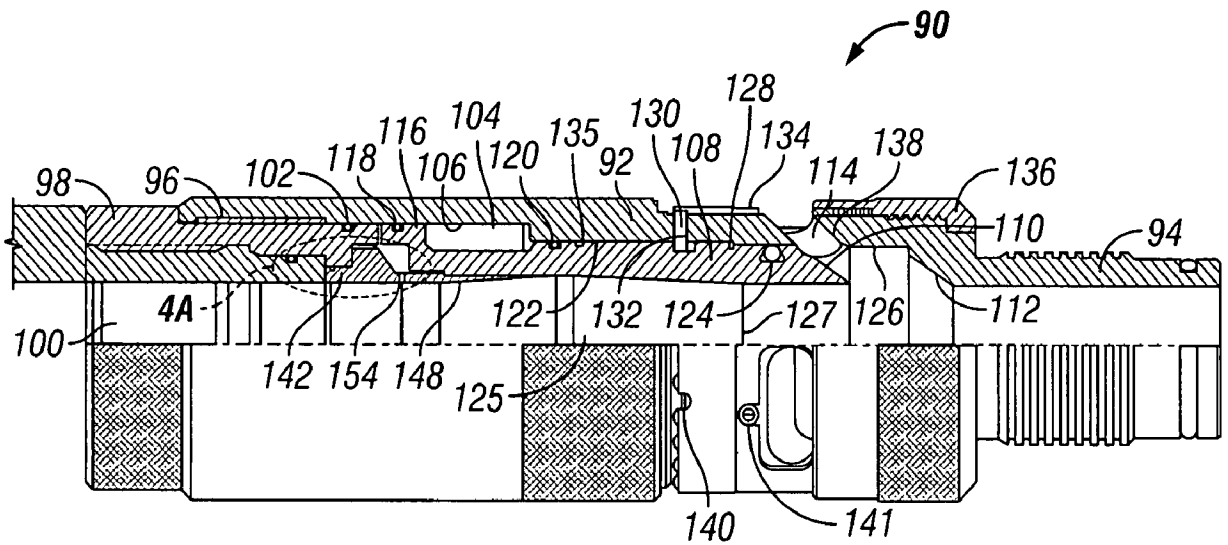
Figure 4A:
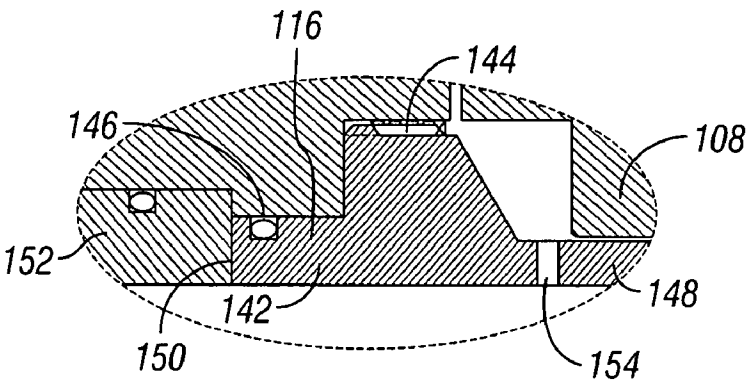
Figure 5:
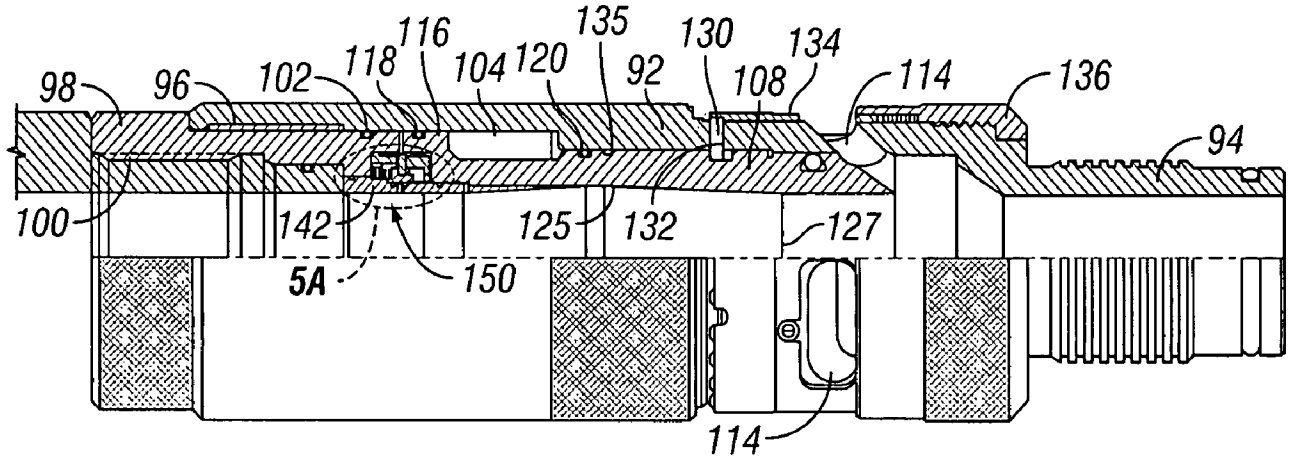
Figure 5A:
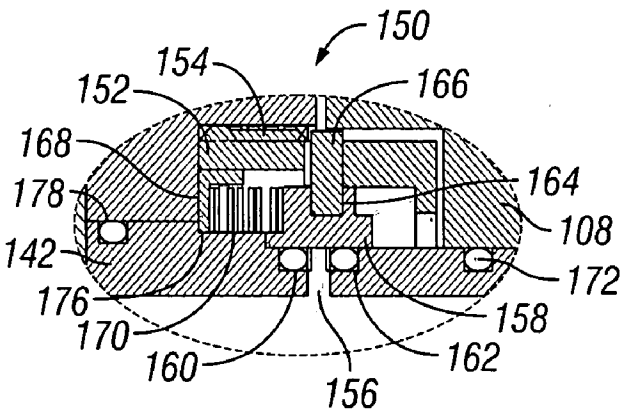

FIG. 1 is a longitudinal cross-sectional view showing a well service tool located within a well casing and embodying a by-pass valve assembly constructed in accordance with the principles of the present invention;

FIG. 2 is a longitudinal partial cross-sectional view showing the by-pass valve assembly of FIG. 1 in greater detail and showing the sleeve valve member thereof being retained in its open position;

FIG. 3A is a longitudinal partial cross-sectional view showing the by-pass valve assembly of FIG. 1 with the unbalanced sleeve valve element thereof in its open position;

FIG. 3B is an enlarged fragmentary sectional view of the broken line area 3B of FIG. 3A, showing the position of the sheared ends of the shear pins and showing the locking ring detail of the by-pass valve assembly at the closed and locked position of the sliding sleeve valve element;

FIG. 4 is a partial longitudinal sectional view showing a sliding sleeve by-pass valve mechanism representing an alternative embodiment of the present invention;

FIG. 4A is a fragmentary sectional view of the broken line oval area 4A of the sliding sleeve by-pass valve mechanism of FIG. 4 showing a portion of the internal erosion sleeve of the by-pass valve mechanism of FIG. 4 in greater detail;

FIG. 5 is a partial longitudinal sectional view showing a by-pass valve mechanism representing a further alternative embodiment of the present invention which includes a pressure test control device preventing closing movement of the by-pass valve mechanism until a predetermined pressure exceeding test pressure is reached; and FIG. 5A is a fragmentary sectional view of the broken line oval area 5A of the sliding sleeve by-pass valve mechanism of FIG. 5 showing the internal flow sleeve and the pressure test control mechanism thereof in greater detail.

DETAILED DESCRIPTION OF PREFERRED EMBODIMENT

Referring now to the drawings and first to FIG. 1, a by-pass valve mechanism or assembly embodying the principles of the present invention is shown generally at 10 and is shown to be located within a well casing 12, such as during its conveyance downwardly through the well casing to a depth or location of interest. The by-pass valve, as illustrated in FIG. 1, is composed of a fixed outer ported housing shown generally at 14 and having upper and lower housing sections 16 and 18, being connected in assembly by an intermediate connection 20. A tubing connector 17 of a conveyance and fluid supplying tubing string is received by a connector 19 defined by the upper end of the upper housing section 14, thus providing for connection of the by-pass valve assembly with the tubing string for fluid supply to a well service tool shown generally at 21 and for conveyance of the well service tool within the well casing.

The lower housing section 18 defines a tool connection 22 to provide for support and fluid communication of the by-pass valve assembly 10 with a well service tool shown generally at 24, which is also referred to herein as a bottom hole assembly. The lower housing section 18 also defines a plurality of flow ports 26 constituting an alternative flow path for fluid flow from an internal flow passage 28 that is collectively defined by the upper and lower housing sections and by an internal closing sliding sleeve valve element 30 and an erosion sleeve element 32. However, it should be borne in mind that the configuration may be inverted, making the housing or fixed component 14 a ported mandrel with an external sliding sleeve valve. The external ported housing/internal sliding sleeve configuration, however, tends to offer more protection than the movable sliding sleeve and can be designed with minimal detrimental flow/erosion effects, thus is the preferred design. In either configuration the fixed component, the housing or mandrel will include threaded connections or a means to connect the by-pass valve to the tubing and bottom-hole assembly.

As shown in FIGS. 1 and 2, the housing 14 of the by-pass valve 10 is composed of upper and lower subs which separate to allow the insertion of the internal sliding sleeve valve element 30. The sliding sleeve valve element 30 is shown in the open position thereof to permit displaced fluid by-pass and is held open by shear pins (screws) 40 located in the upper housing sub 16. The number of shear pins or screws may be varied to determine the closure pressure or depth. The upper housing sub 16 primarily offers a means to insert and protect the upper area of the sliding sleeve, while the lower housing sub 18 provides flow through ports and sealing surfaces to mate with the internal sliding sleeve valve element 30.

The well service or treatment tool 21 shown in FIG. 1 is a straddle packer well treatment tool which is typically utilized for injecting formation fracturing fluid into an isolated casing zone between straddle packer elements 34 and 36 which establish seals within the well casing 12. Another cup packer element 38 faces downwardly and prevents casing fluid from flowing upwardly past the well service tool and protects the well service tool any pressure sensitive components thereof from any excessive pressure condition. Though not shown in FIG. 1, the casing interval between the packer elements at the intended well treatment depth will have been perforated, such as by the controlled firing of a plurality of shaped explosive charges to thus provide fluid communication of the well casing with the formation that is intended to be completed and produced. The condition of the well service or treatment tool 21 and the by-pass valve mechanism 10 of FIG. 1 is indicative of the condition during running (tubing conveyance) of the well service or treatment tool and the by-pass valve mechanism to the desired depth for treatment.

The upper valve housing sub 16 defines an internal generally cylindrical sliding sleeve recess 42 which receives the upper tubular end portion 43 of the internal closing sliding sleeve valve element 30. At the upper end of the internal cylindrical sealing surface 42 the upper housing sub 16 defines a circular stop shoulder 44 that limits upward movement of the internal closing sliding sleeve valve element 30. The upper housing sub also provides an internal seal recess within which is received a circular seal 46 having sealing engagement with an external cylindrical sealing surface 47 of the sliding sleeve valve element 30. The internal closing sliding sleeve valve element 30 defines a shear pin groove or a plurality of shear pin recesses 48 which receive end portions of the shear pins 40. The shear pins serve to retain the sliding sleeve valve element 30 at its open position, permitting by-pass flow through the by-pass valve mechanism as it and the service tool connected to it displace well fluid during running thereof to desired depth or location the well casing. An annular external piston boss or flange 50 is provided intermediate the extremities of the sliding sleeve valve element 30 and defines an annular piston seal recess 52 retaining an annular piston seal element 54 in sealing engagement with an internal cylindrical sealing surface 56 within the lower housing sub 18. It should be noted that the piston seal or seal assembly 54 establishes a greater seal diameter as compared with the seal diameter of the annular seal 46.

During running of the well service tool and by-pass valve assembly, it should be noted that the by-pass valve sleeve 30 is open, thereby permitting fluid in the well casing below the well service tool to flow through the well service tool and by-pass valve, as shown by flow arrows, and permitting the displaced well fluid of the casing to by-pass the cup type packer elements of the well service tool.

At the intermediate connection 20 the upper and lower housing subs 16 and 18 define registering pressure ports 60, with an annular filter element 62 being positioned to prevent well fluid particulate from entering the sleeve valve recess 42, where it might interfere with the operation of the sleeve valve element. In the open or assembled position the internal closing sliding sleeve valve element 30 and housing seal on different diameters to create a trapped atmospheric chamber 58 during assembly of the by-pass valve mechanism. Air within the atmospheric chamber 58 is compressed as the sleeve valve element is moved to its closed position responsive to differential pressure, thus cushioning the closing movement an preventing the sleeve valve from slamming against the housing structure as it reaches its closed position. As the valve is lowered into the well fluid along with a well tool to which it is assembled, hydrostatic pressure within the tubing and by-pass valve mechanism will increase, causing a differential pressure to build across the sliding sleeve piston, thus creating a force equal to the differential pressure times the pressure responsive piston area. When the force created by hydrostatic pressure or pump in pressure within the tubing exceeds the shear pin value, the shear pin or pins will shear and the valve will be closed by the resultant force of the pressure differential acting on the sleeve valve element. Annulus pressure and fluid affect the piston of the sliding sleeve valve via small pressure ports 60 that are located just below the shear pins and thus communicate annulus pressure to the flow passage 28 of the by-pass valve. Thus, the sliding sleeve valve mechanism 10 is actuated to its closed position by a pressure differential of tubing pressure and casing pressure acting on the pressure responsive area of the sliding sleeve valve element 30. The pressure ports 60 are provided with one or more filter or screen elements 62 to prevent particulate of the fluid that might be present in the annulus between the service tool and the well casing from contaminating and potentially fouling the sliding sleeve valve mechanism or the sealing surface 42 to which the sliding sleeve valve element 30 is sealed.

The by-pass valve mechanism 10 is also provided with a locking mechanism to mechanically hold the sliding sleeve valve element 30 closed after valve closure has occurred. As shown in all of the figures and in greater detail in FIG. 3B, the sliding sleeve valve element 30 defines an external locking groove or recess 64. A lock ring 66 is engaged by an annular inclined cam shoulder 68 of the intermediate connection portion 21 of the upper sub 16. The lock ring 66, shown in the enlarged view of FIG. 3B, is split and expanded over the sliding sleeve valve element 30, leaving an inward bias to drive it into the mating locking groove 64 when the sleeve valve element reaches its closed position. In the expanded position shown in FIG. 2 the lock ring 66 is held in position by the housing cylinder shoulder. When the sliding sleeve valve element 30 is moved to its closed position responsive to hydrostatic pressure and perhaps casing pressure as well, as shown in FIG. 3A, the inward bias of the lock ring 66 and the cam force of the tapered or inclined cam shoulder will urge the lock ring into the locking groove 64. When the lock ring 66 has entered the locking groove 64 the sliding sleeve valve element 30 will have completely closed and will be retained at its closed position by the lock ring. It should be noted as shown in FIGS. 3A and 3B that the tips of the sheared shear pins will be captured within the shear pin groove or receptacle 48 and thus will not fall into the well casing or into the flow passage 30 of the by-pass valve.

The erosion sleeve 32 shown in FIGS. 1, 2 and 3A provides an expendable replaceable sleeve which is used to ensure that the flow path through the by-pass valve is substantially straight and substantially free of shoulders, edges and voids that can cause the development of turbulence in the flow stream. The development of turbulence if the fluid flow could interfere with the velocity of treatment fluid being pumped through the well service tool and into the surrounding production formation. The erosion sleeve 32 functions to cover the annular void that is created as the upper end of the sleeve valve element 30 is moved downwardly to its closed position within the recess 42 of the by-pass valve housing 15. This feature minimizes turbulence of the flowing treatment fluid within the central passage 28 of the by-pass valve mechanism 10, so that the erosive nature of the treatment fluid will not erode the internal surfaces of the valve mechanism. This feature also prevents accumulation of particulate within the valve recess 42, where it might otherwise interfere with movement of the sleeve valve element. The erosion sleeve 32 defines at least one and preferably a plurality of pressure interchange ports 33 that permit the pressure of the fluid within the internal flow passage 28 to be communicated into the annular void of the sliding sleeve recess 42 and prevents a condition of fluid locking to occur that might otherwise interfere with downward closing movement of the sliding sleeve valve element 30. The pressure interchange ports 33 are of sufficiently small diameter that only a very small quantity of the solid particulate, sand and proppant, of the treatment fluid or slurry will be permitted to enter the annular void as fluid 10 interchange occurs. Moreover, the erosion sleeve element 32 is not sealed with respect to the internal surface of the sliding sleeve valve element 30, thus permitting some fluid interchange to occur between the erosion sleeve element and the sliding sleeve valve element.

The lower housing sub 18 defines a plurality of by-pass ports 70 that are open to permit by-pass flow of displaced well fluid when the sliding sleeve valve 30 is held at its open position by the shear pins as shown in FIG. 2. When the shear pins or screws have become sheared, releasing the sliding sleeve valve element 30 for differential pressure responsive movement to the closed position thereof, as shown in FIG. 3A, by-pass flow through the by-pass valve mechanism will be blocked by a lower annular valve portion 75 of the tubular sliding sleeve valve element 30. A middle or intermediate seal 72 and a lower seal 74 are carried within seal grooves of the lower annular valve portion 75 of the sliding sleeve valve element 30 and are located so as to be positioned, respectively, above and below the by-pass ports 70 of the lower housing section 18. The lower annular valve portion 75 of the sliding sleeve valve element 30 defines an external reduced diameter section 76 having an external lower seal groove within which the lower seal 74 is received. This reduced diameter lower end section causes the lower seal 74 to be slightly spaced from the inner cylindrical surface 78 of the lower housing section 18 so that sealing between the lower portion of the sliding sleeve valve element 30 and the lower housing section 18 during downward movement of the sliding sleeve valve element 30 occurs only at the intermediate seal 72. Thus, as the sliding sleeve valve element 30 is moved downwardly to its closed position, the lower annular seal 74 will not be in sealing engagement with the lower housing section and will not be pressure extruded and damaged as it moves across the by-pass ports 70. Below the by-pass ports 70 the lower housing section 18 defines an internal annular sealing surface 80 having an internal diameter that is slightly smaller than the internal diameter of the internal cylindrical sealing surface 78. During closing movement of the sliding sleeve valve element 30 the lower annular sealing element 74, after having cleared the by-pass ports 70, will move into sealing engagement with the slightly smaller internal annular sealing surface 80. As the sliding sleeve valve element 30 reaches the downward limit of its closing movement, the lower tapered end surface 82 of the sliding sleeve valve element can establish metal-to-metal sealing with the correspondingly tapered internal surface 84 of the lower housing section 18.

It is evident that the sliding sleeve and housing sealing areas are staggered to create a hydraulic assist from tubing pressure in both the open and closed positions. In the open position of the sliding sleeve valve element, with circulation down the tubing creating a greater pressure in the tubing than in the annulus, the differential pressure acting on the upper seal 46 and the middle or intermediate seal 72 will tend assist the shear pins or screws and help hold the valve open; however at no time may the annulus hydrostatic pressure exceed the set (shear) pressure of the shear pins or screws. In the closed position of the sliding sleeve valve element 30 the lower pressure responsive area defined by the lower seal 74 is smaller than the upper pressure responsive area defined by the seal 46, and thus tubing pressure tends to hold the sliding sleeve valve tightly closed. The smaller lower seal diameter of the seal also prevents the lower seal 74 from contacting the ported area as the sliding sleeve valve element 30 is moved to its closed position.

In many cases it is desirable to provide a by-pass valve mechanism having the attributes described above, but which has a length that is minimal, so that the overall length of the service tool string can be minimized. According to FIGS. 4 and 4A, a by-pass valve mechanism representing an alternative embodiment of the present invention is shown generally at 90 and comprises a valve housing 92 having a lower externally threaded pin connection 94 for connection with a service tool in the manner shown in FIG. 1. The valve housing 92 defines an upper internally threaded connector 96 receiving a tubing connector member 98 having an internally threaded section 100 which receives a tubing connector or any other element being a component of the service tool string or tubing string. The tubing connector member 98 is sealed to the tubular valve housing 92 by an annular sealing member 102.

Within the valve housing 92 is defined an annular piston chamber 104 having an inner cylindrical piston sealing surface 106. A tubular sliding sleeve valve element 108 is moveable within the valve housing 92 between an open position as shown in FIG. 4 and a closed position where a lower tapered end 110 of the sleeve valve element is in contact with a correspondingly tapered internal surface 112 within the valve housing. In its closed position, the sliding sleeve valve element closes a plurality of by-pass ports 114 that are defined by the valve housing. The tubular sliding sleeve valve element 108 defines an annular piston boss or flange 116 having an annular seal groove within which is located a piston seal or seal assembly 118. The piston seal or seal assembly is also referred to herein as an upper seal, that is disposed in sealing engagement with the inner cylindrical piston sealing surface 106 of the valve housing 92. An intermediate or middle seal 120 is carried within an annular external seal groove of the sleeve valve element 108 and establishes sealing engagement with an internal cylindrical surface 122 of the valve housing 92. The sleeve valve element 108 also defines a lower annular seal groove retaining a lower annular seal element 124 in position for sealing with an internal sealing surface 126 of the valve housing 92. The sleeve valve element 108 defines a reduced diameter external surface section 128 that has sufficient clearance with the internal cylindrical surface 122 that prevents the lower annular seal element 124 from sealing when the sleeve valve element is in its open position. However, the internal sealing surface 126 is of slightly smaller internal diameter as compared with the internal cylindrical surface 122 so that sealing engagement of the sleeve valve element and the valve housing is established when the sleeve valve element is moved to its closed position. The different diameters of the internal surfaces 122 and 126 and the external surface section 128 prevent the lower annular sleeve valve seal element 124 from being damaged when it is moved across the by-pass ports 114 during closing movement of the sleeve valve element 108.

The sleeve valve element 108 defines a gradually tapered internal flow passage surface section 125 that tapers to a slight restriction 127 which causes the pressure responsive area of the sleeve valve member to extend from the annular seal diameter of the seal 102 to the restriction 127. Fluid pressure within the flow passage of the sleeve valve element 108 acting on the pressure responsive area develops a force acting on the sleeve valve element 108 and being opposed by annulus pressure acting through the by-pass ports, develops a resultant force that tends to close the sleeve valve element.

At least one and preferably a plurality of shear pins 130 are secured within shear pin receptacles 132 of the valve housing 92 by means of a sleeve type shear pin retainer 134. The shear pin retainer 134 is secured to the valve housing by a housing retainer 136 that is threaded to the lower portion of the valve housing 92. The sleeve type shear pin retainer 134 is in spring loaded assembly with the housing retainer 136 so that it can be retracted against the compression of a spring member 138 to permit the shear pins 130 to be installed within their receptacles 132. The sleeve type shear pin retainer 134 may define shear pin recesses as shown at 140 that permit the shear pins to be easily installed. Set screws 141 are received within set screw receptacles of the shear pin retainer 134 and are threaded into the valve housing 92 to prevent downward movement of the shear pin retainer 134 after the shear pins have been installed. When the pressure responsive resultant force acting on the sleeve valve element exceeds the (set) force that is required to shear the shear pins, the sleeve valve element will be released and will be moved to the closed position. When this occurs, the pressure of fluid flowing through the by-pass valve mechanism will tend to maintain the sleeve valve element at its closed position. The sleeve valve element is also provided with an external latch groove or receptacle 135 that moves into registry with the shear pin receptacles 132 when the sleeve valve element has moved to its closed position. The shear pin retainer also defines a tapered internal surface that urges the shear pins radially inwardly after the inner ends of the shear pins have been sheared away. Thus, when the external latch groove or receptacle 135 moves into registry with the shear pin receptacles the remaining portions of the shear pins will enter the external latch groove or receptacle and function to mechanically retain the sleeve valve element at its closed position.

An erosion sleeve element 142, shown in greater detail in FIG. 4A is mounted within the tubing connector member 98 by a thread connection 144 and is sealed with respect to the tubing connector member 98 by an annular seal member 146. The erosion sleeve element 142 defines an extended tapered sleeve 148 that projects into the central passage of the sleeve valve element 108 and ensures against the development of turbulence in the flow of treatment slurry that is caused to flow through the central passage of the sleeve valve element. The abrupt upper end 150 of the erosion sleeve element 142 will be disposed in substantial abutment with the lower end 152 of a connector member that is disposed in threaded assembly within the tubing connector member 98, thus ensuring smooth transition of fluid flow through the flow passage of the by-pass valve mechanism. The erosion sleeve element 142 defines at least one and preferably a plurality of pressure ports 154 that provide for pressure interchange of the flowing treatment slurry with the annular piston chamber for activating the sleeve valve element 108 against the restraint of the shear pins 130.

Referring now to FIGS. 5 and 5A, there is shown a further alternative embodiment of the present invention that is generally of the construction and operation as discussed above in connection with FIGS. 4 and 4A. This embodiment of the present invention permits pressure testing of a well to ensure the sealing integrity of the various internal seals, packers and other pressure controlling features of the well without causing closure of the by-pass valve by the test pressure that is applied. Pressure testing is permitted by a pressure test control mechanism shown generally at 150 to a pressure test value that is greater than the set pressure for pressure responsive closure of the sleeve valve mechanism. Multiple pressure tests may be conducted to a pressure less than the set conversion pressure of the test control mechanism. A single pressure test must be performed in excess of the test control mechanism set pressure to disable the test mechanism, allowing the sleeve valve mechanism to operate as described above without the test control mechanism. Like components in the embodiment of FIGS. 5 and 5A will be referred to by like reference numerals as employed in connection with FIGS. 4 and 4A. As shown in greater detail in FIG. 5A, the pressure test control mechanism 150 employs a fixed ring 152 that is mounted to the tubing connector member 98 by means of a thread connection 154. The test pressure, which enters the by-pass valve mechanism via the by-pass ports 114, is communicated to the pressure test control mechanism 150 via pressure ports 156. The test pressure is isolated from the pressure responsive area defined by the piston seal 118 by a pressure isolation ring 158 and a pair of annular seals 160 and 162 that are retained within annular seal grooves of the erosion sleeve element 142. The pressure isolation ring 158 defines an external groove 164 within which are seated multiple shear pins 166 having engagement with fixed ring 152. A spring follower ring 168 is located between the fixed ring and the erosion sleeve element 142 and is disposed in contact with a spring member or spring package 170 that also bears against the pressure isolation ring 158. Isolation ring 158 is held in the pressure isolating position by shear pins 166 which are retained by the fixed ring 152.

When test pressure is being applied it is blocked from acting on the pressure responsive area of the piston seal 118 by the annular seals 160 and 162 which seal against the pressure isolation ring 158. The test pressure acts on the pressure responsive area of the erosion sleeve element 142 that is defined by annular seals 172 and 178, thus causing the erosion sleeve element to apply a force to the spring follower 168 and pressure isolation ring 158 simultaneously. The pressure isolation ring 158 will remain in the test or pressure isolating position until a force caused by the applied test pressure and applied by the erosion sleeve exceeds the shear strength of shear pins 166. Pressure tests may be repeated many times as long as the set pressure for the test control mechanism 150 is not exceeded. Once the test control set pressure is exceeded, pins 166 shear, allowing the erosion sleeve assembly 142, spring 170, spring follower 168, and the isolation ring 158 to all move together until isolation ring 158 lands solidly on fixed ring 152. This movement will not break annular seals 160 and 162 and the seal will remain until the test pressure is removed. Thus, the test pressure will not be applied to the pressure responsive area defined by the piston 116 portion of the sleeve valve 30. Upon bleed-off or removal of the test pressure, spring 170 forces erosion sleeve 142 to return to its original position, separating isolation ring 158 from seals 160 and 162, thus opening ports 156 and exposing the pressure responsive area of piston 116. Once the test control set pressure is exceeded and removed, the test control mechanism is disabled and subsequent application of pressure will be applied to the pressure responsive surface area of the piston, causing the piston to shear the shear pins or screws 130. This causes release of the sleeve valve element and permits the pressure responsive force on the piston area to close the sleeve valve element in the manner described above. The sleeve valve element 108 will then remain closed, being locked against opening movement by the sheared ends of the shear pins 130, permitting well service activities to be carried out.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A by-pass valve mechanism in combination with a well treatment tool having at least one packer element for sealing within the well casing of a well, permitting by-pass of well fluid past the packer element of the well treatment tool during conveyance of the well treatment tool within the well casing, comprising:

a by-pass valve housing being connected with a well tool and defining an internal flow passage in communication with a tubing string and at least one by-pass port establishing communication of the internal flow passage with an annulus between said by-pass valve housing and the well casing;

a valve element being moveable within said by-pass valve housing between an open position permitting flow of well fluid through said at least one by-pass port and a closed position blocking the flow of well fluid through said at least one by-pass port;

at least one retainer securing said valve element at said open position permitting fluid by-pass during tool running and releasing said valve element for closing movement responsive to predetermined fluid pressure.

2. The by-pass valve mechanism of claim 1, wherein said predetermined fluid pressure is tubing pressure.

3. The by-pass valve mechanism of claim 1, wherein said predetermined fluid pressure is the hydrostatic pressure of fluid within the well casing.

4. The by-pass valve mechanism of claim 1, comprising:

said by-pass valve housing defining an annular valve seat; and said valve element being a tubular sleeve valve element located at least partially within said annular valve receptacle and defining a valve member, said tubular sleeve valve element being linearly moveable from an open position with said valve member retracted from said annular valve seat and permitting fluid flow through said at least one by-pass port and a closed position with said tubular valve portion establishing sealed engagement with said annular valve seat and blocking fluid flow through said at least one by-pass port.

5. The by-pass valve mechanism of claim 4, comprising:

said by-pass valve housing defining an internal housing sealing surface having a defined internal diameter;

said annular valve seat having an internal seat surface having a diameter less than said defined internal diameter; and said tubular valve portion having a middle seal of a diameter establishing sealing engagement only with said internal housing sealing surface and having a lower seal of a diameter establishing sealing engagement only with said internal seat surface.

6. The by-pass valve mechanism of claim 5, comprising:

said internal housing sealing surface and said internal seat surface each being of cylindrical configuration and being of differing diameters.

7. The by-pass valve mechanism of claim 1, comprising:

said by-pass valve housing defining a valve receptacle and an annular valve seat; and said valve element being a tubular sleeve valve element located at least partially within said annular valve receptacle and defining a circular valve member, said tubular sleeve valve element being linearly moveable within said valve receptacle from an open position with said valve member retracted from said annular valve seat and permitting fluid flow through said at least one by-pass port and a closed position with said tubular valve portion located within said valve receptacle and establishing sealed engagement with said annular valve seat and blocking fluid flow through said at least one by-pass port.

8. The by-pass valve mechanism of claim 1, comprising:

said by-pass valve housing defining a piston sealing surface;

said valve element being a sleeve valve element having an annular piston seal disposed in sealing engagement with said piston sealing surface and defining a pressure responsive area; and fluid pressure within said flow passage acting on said pressure responsive area and developing a resultant force urging said sleeve valve element toward said closed position thereof.

9. The by-pass valve mechanism of claim 1, comprising:

said valve element being a tubular sleeve valve element defining at least one hydraulic area; and fluid pressure within said flow passage acting on said at least one hydraulic area and maintaining said tubular sleeve valve element at said closed position one valve closure has occurred.

10. The by-pass valve mechanism of claim 1, comprising:

said at least one retainer being at least one shear element retaining said valve element at said open position thereof and shearing responsive to predetermined force on said valve element and releasing said valve element for pressure responsive closing movement.

11. The by-pass valve mechanism of claim 1, comprising:

said by-pass valve housing having upper and lower housing subs being releasably connected and defining an annular chamber having a generally cylindrical piston sealing surface;

said valve element being a sleeve valve member having an annular piston seal disposed in sealing engagement with said piston sealing surface; and an upper seal element and a middle seal element establishing sealing between said sleeve valve element and said upper and lower housing subs on opposing sides of said annular piston seal and being of substantially equal sealing diameter.

12. The by-pass valve mechanism of claim 11, comprising:

said annular piston seal engaging said generally cylindrical piston sealing surface defining a hydraulic area of said sleeve valve element; and at least one pressure port being defined in said by-pass valve housing and communicating annulus pressure externally of said by-pass valve housing to said hydraulic area of said sleeve valve element and developing a pressure responsive force urging said sleeve valve element toward said closed position thereof.

13. The by-pass valve mechanism of claim 1, comprising:

said by-pass valve housing defining an internal sleeve valve recess;

said valve element being a tubular sleeve valve member moveable within said internal sleeve valve recess between said open and closed positions; and a tubular erosion sleeve element being located within said by-pass valve housing and having a portion thereof extending within said sleeve valve member and defining a protective internal covering minimizing the development of turbulence within said by-pass valve housing by-pass valve housing and minimizing fluid flow erosion of said sleeve valve element and said sleeve valve recess.

14. The by-pass valve mechanism of claim 1, comprising:

said valve element being a tubular sleeve valve member moveable within said by-pass valve housing during closing movement thereof, said tubular sleeve valve member defining a locking recess; and a lock member located within said by-pass valve housing and being moveable into said locking recess upon closure of said tubular sleeve valve member and securing said tubular sleeve valve member at said closed position.

15. A method for by-passing well fluid past a packer element of a well treatment tool having a treatment fluid passage during conveyance of the well treatment tool within the well casing, comprising:

connecting a by-pass valve mechanism to the well treatment tool, said by-pass valve mechanism having a by-pass valve body defining a flow passage being in communication with said treatment fluid passage and having at least one by-pass port for communicating said flow passage with an annulus between the well treatment tool and the well casing, said by-pass valve mechanism having a valve element being moveable within said by-pass valve housing between an open position permitting by-pass flow of well fluid through said at least one by-pass port and a closed position blocking by-pass flow of well fluid through said at least one by-pass port;

connecting said by-pass valve body with a string of conveyance and treatment fluid supply tubing;

retaining said valve element at said open position during running of said well treatment tool and by-pass valve mechanism and permitting by-pass of fluid between said treatment fluid passage and said annulus;

releasing said valve element from said open position responsive to fluid pressure; and causing pressure responsive movement of said by-pass valve element from said open position to said closed position.

16. The method of claim 15, comprising:

upon closing of said valve element, retaining said valve element at said closed position.

17. The method of claim 15, comprising:

employing tubing pressure for said pressure responsive movement of said valve element to said closed position.

18. The method of claim 15, comprising:

employing hydrostatic pressure of fluid for said pressure responsive movement of said valve element to said closed position.

19. The method of claim 15, wherein at least one shear element retains said valve element at said open position and said valve element is sealed to said by-pass valve body and defines a piston area, said method comprising:

said releasing step being applying sufficient pressure responsive force to said piston area to shear said at least one shear element and release said valve element from said by-pass valve body; and applying sufficient pressure responsive force to said piston area to move said valve element from said open position to said closed position.

20. The method of claim 19, wherein said valve element defines a lock recess and a lock member is retained within said by-pass valve body and enters said lock recess when said valve element reaches said closed position, said method comprising:

causing pressure responsive movement of said valve element toward said closed position and positioning said lock recess in registry with said lock member; and moving a portion of said lock member into said lock recess and causing said lock member to retain said valve element at said closed position.

21. A by-pass valve mechanism in combination with a well treatment tool having at least one packer element for sealing within the well casing of a well, permitting by-pass of well fluid past the packer element of the well treatment tool during conveyance of the well treatment tool within the well casing, comprising:

a by-pass valve housing being connected with a well tool and defining an internal flow passage in communication with a tubing string and having at least one by-pass port establishing communication of the internal flow passage with an annulus between said by-pass valve housing and the well casing, said by-pass valve housing defining an annular internal valve receptacle and an annular internal valve seat;

a tubular valve element being moveable within said annular internal valve receptacle between an open position permitting flow of well fluid through said at least one by-pass port and a closed position establishing sealing with said annular internal valve seat and blocking the flow of well fluid through said at least one by-pass port and permitting the flow of fluid through said internal flow passage;

at least one shear element being mounted to said by-pass valve housing and having retaining engagement with said tubular valve element and securing said valve element at said open position permitting fluid by-pass during tool running and being sheared and releasing said valve element for closing movement responsive to predetermined fluid pressure.

22. The by-pass valve mechanism of claim 21, wherein said predetermined fluid pressure is tubing pressure.

23. The by-pass valve mechanism of claim 21, wherein said predetermined fluid pressure is the hydrostatic pressure of fluid within the well casing.

24. The by-pass valve mechanism of claim 21, comprising:

said by-pass valve housing defining an internal housing sealing surface having a defined internal diameter;

said annular valve seat having an internal seat surface having a diameter less than said defined internal diameter; and said tubular valve portion having a middle seal of a diameter establishing sealing engagement only with said internal housing sealing surface and having a lower seal of a diameter establishing sealing engagement only with said internal seat surface.

25. The by-pass valve mechanism of claim 21, comprising:

said internal housing sealing surface and said internal seat surface each being of cylindrical configuration and being of differing diameters; and said lower seal being spaced from said internal housing sealing surface and establishing sealing engagement with said internal seat surface preventing damage to said lower seal during movement of said sliding sleeve valve element to said closed position.

26. The by-pass valve mechanism of claim 21, comprising:

said annular valve seat defining an internal seat receptacle; and said tubular valve element defining a tubular valve member establishing sealed engagement within said internal seat receptacle at said closed position of said tubular valve element and blocking fluid flow through said at least one by-pass port and permitting fluid flow through said tubular valve member.

27. The by-pass valve mechanism of claim 21, comprising:

said by-pass valve housing defining an internal piston sealing surface;

said tubular sleeve valve element having an annular piston seal disposed in sealing engagement with said piston sealing surface and defining a pressure responsive area; and fluid pressure within said flow passage acting on said pressure responsive area and developing a resultant force urging said tubular sleeve valve element toward said closed position thereof; and fluid pressure within said flow passage acting on said pressure responsive area and maintaining said tubular sleeve valve element at said closed position once valve closure has occurred.

28. The by-pass valve mechanism of claim 21, comprising:

said by-pass valve housing having upper and lower housing subs being releasably connected and defining an annular chamber having a generally cylindrical piston sealing surface;

said tubular sleeve valve element having an annular piston seal disposed in sealing engagement with said piston sealing surface; and an upper seal element and a middle seal element establishing sealing between said tubular sleeve valve element and said upper and lower housing subs on opposing sides of said annular piston seal and being of substantially equal sealing diameter.

29. The by-pass valve mechanism of claim 28, comprising:

said annular piston seal engaging said generally cylindrical piston sealing surface defining said pressure responsive area of said tubular sleeve valve element; and at least one pressure port being defined in said by-pass valve housing and communicating annulus pressure externally of said by-pass valve housing to said pressure responsive area of said sleeve valve element and said annulus pressure and tubing pressure developing a pressure responsive force urging said tubular sleeve valve element toward said closed position thereof.

30. The by-pass valve mechanism of claim 21, comprising:

said by-pass valve housing and said tubular sleeve valve element defining a sealed variable volume atmospheric chamber therebetween; and air present within said sealed atmospheric chamber being compressed by decreasing volume of said variable volume atmospheric chamber during closing movement of said tubular sleeve valve element and cushioning closing movement thereof.

31. The by-pass valve mechanism of claim 21, comprising:

a test pressure control mechanism being present within said by-pass valve housing and permitting application of predetermined maximum test pressure to the well without causing shearing of said at least one shear element.

* * * * *